166-307 SR
1/28/86 OR 4,566,539

United States Patent [19]
Perlman

[11] Patent Number: 4,566,539
[45] Date of Patent: Jan. 28, 1986

[54] COAL SEAM FRACING METHOD

[76] Inventor: William Perlman, 2302 Niels Esperson Bldg., Houston, Tex. 77002

[21] Appl. No.: 631,592

[22] Filed: Jul. 17, 1984

[51] Int. Cl.[4] ..... E21B 43/267; E21B 43/27
[52] U.S. Cl. ..... 166/307; 166/380; 166/280
[58] Field of Search ..... 166/308, 307, 281, 282, 166/280

[56] References Cited

U.S. PATENT DOCUMENTS

| | | | |
|---|---|---|---|
| 2,774,431 | 12/1956 | Sherborne | 166/280 |
| 2,802,531 | 8/1957 | Cardwell et al. | 166/280 |
| 3,149,674 | 9/1964 | Schutze et al. | 166/280 |
| 3,167,123 | 1/1965 | Graham et al. | 166/279 |
| 3,235,007 | 2/1966 | Kern et al. | 166/279 |
| 3,349,851 | 10/1967 | Huitt et al. | 166/280 |
| 3,374,835 | 3/1968 | Knox | 166/282 |
| 3,384,416 | 5/1968 | Ruehl et al. | 166/308 |
| 3,412,797 | 11/1968 | Huitt et al. | 166/308 |
| 3,433,740 | 3/1969 | Armentrout | 252/8.5 |
| 3,437,148 | 4/1969 | Colpoys, Jr. | 166/308 |
| 3,709,300 | 1/1973 | Pye | 166/280 |
| 3,768,564 | 10/1973 | Knox et al. | 166/307 |
| 3,818,990 | 6/1974 | Coulter | 166/280 |
| 3,842,911 | 10/1974 | Knox et al. | 166/307 |
| 3,918,524 | 11/1975 | Broaddus et al. | 166/307 |
| 3,923,666 | 12/1975 | Dill | 166/308 X |
| 3,934,651 | 1/1976 | Nierode et al. | 166/282 |
| 3,954,142 | 5/1976 | Broaddus et al. | 166/307 |
| 4,186,802 | 2/1980 | Perlman | 166/280 |
| 4,245,699 | 1/1981 | Steeman | 166/308 X |
| 4,245,702 | 1/1981 | Haafkens et al. | 166/308 X |
| 4,283,089 | 8/1981 | Mazza et al. | 166/308 X |
| 4,305,464 | 12/1981 | Mazzi | 166/308 X |
| 4,471,840 | 9/1984 | Lasseter et al. | 166/308 X |

OTHER PUBLICATIONS

Lambert, S. W. et al., "Improved Methods for Monitoring Production from Vertical Degasification Wells," U.S. BOM, R.I. 8309 (1978).

Lambert, S. W. et al., "Methane Drainage: Experience with Hydraulic Stimulation Through Slotted Casing," U.S. BOM, R.I. 8295 (1978).

Trevits, M. A. et al., "Methane Drainage: Identification and Evaluation of the Parameters Controlling Induced Fracture Geometry," SPE/DOE 10820 (1982).

Lambert, S. W. et al., "Methane Drainage Ahead of Mining Using Form Stimulation," U.S. DOE, RI--PMTC-3 (1979).

*Primary Examiner*—Stephen J. Novosad
*Attorney, Agent, or Firm*—Pravel, Gambrell, Hewitt & Kimball

[57] ABSTRACT

A method of hydraulically fracturing subterranean coal seams to improve the rate and total recovery of gas therefrom. The coal seam is fractured with acid and a proppant-laden fracing fluid in alternating injection stages. The initial injection stage of the fracturing fluid contains from about 0 to about 4 pounds of a spherical proppant having a particle size distribution substantially between 60 and 140 mesh. The subsequent fracing fluid injection stages are alternated with injection stages of a smaller volume of acid. The proppant loading in the fracing fluid is increased with each injection stage until the loading is from about 8 to about 12 pounds of proppant per gallon of fluid. The subsequent and terminal fracing fluid injection stages are with the higher proppant loading. Preferably, the volume of the fracing fluid injection stages is increased in successive stages from about 2000 to about 4000 gallons per stage initially to from about 6000 to about 8000 gallons per stage in the subsequent and terminal stages. The terminal fracing fluid injection stage is followed by a flushing of the well with a proppant-free fluid.

34 Claims, No Drawings

COAL SEAM FRACING METHOD

FIELD OF THE INVENTION

This invention pertains to hydraulically fracturing earth formations, and more particularly to the hydraulic fracturing of subterranean gas-containing coal formations, i.e. coal seams, for the purpose of increasing the producing rate and total amount of recovery of gas from a well completed in such a formation.

BRIEF DESCRIPTION OF THE PRIOR ART

Hydraulic fracturing techniques for hydrocarbon formations are well known and have been extensively used for increasing the recovery of oil and gas from hydrocarbon bearing formations. These techniques involve injecting a fracing fluid down the wellbore and into contact with the formation to be fractured. Sufficiently high pressure is applied to the fracing fluid to initiate and propagate a fracture into the formation. Propping materials are generally entrained in the fracing fluid and deposited in the fracture to maintain the fracture open during production.

A hydraulic fracturing technique particularly well suited for fracturing low permeability (10 millidarcies or less) gas bearing sandstone formations is described in U.S. Pat. No. 4,186,802. This method includes multiple fracing stages carrying a fine proppant sand of between 60 to 140 mesh size in a sand to fluid ratio mix of 4 pounds/gallon or higher. Each carrier stage is immediately followed by a corresponding spacer stage comprising the fracing fluid without a proppant added. Immediately following the final carrier stage and corresponding spacer stage, a terminating stage carrying a medium proppant sand of a 20 to 40 mesh size is injected, followed by a fracing fluid flush of the tubing string. The fracing fluid was made up of up to 70 percent alcohol by volume in order to reduce the water volume of the fracing fluid which adversely reacted with water sensitive clays within the formation. Up to 20 percent liquified $CO_2$ by volume was combined with the frac water/alcohol mixture to further reduce the water volume.

Coal seams differ from typical subsurface formations from which hydrocarbons are normally recovered, such as carbonate or a sandstone formations. Coal seams are typically much more friable than carbonates or sandstones. Thus, when conventional fracing methods are used, the proppants normally used have a tendency to generate small coal particles from the faces of the fracture which become mixed with the proppant. When the well is put into production, additional coal particles tend to slough off of the faces of the fractures into the proppant. The presence of the coal particles in the proppant tends to plug off the intersticial spaces between the proppant particles and concomitantly reduces the conductivity of the propped fracture. The coal particles also adversely affect the functioning of surface separating and processing equipment.

In addition, coal seams are subject to plastic deformation. When conventional 20–40 mesh proppants are used, they are abrasive to the fracture faces. Proppants in the fracture faces and the creep of the coal into the fracture results in reducing the width and conductivity of the fracture.

Further, conventional fracturing techniques result in wide fractures at the lowermost portion of the coal seam which narrow as they near the uppermost portion of the coal seam, limiting communication between the upper portions of the coal seam and the fracture. Further complicating the fracture of coal seams, the coal seams are typically saturated with water having a high carbonate concentration. Conventional fracing results in precipitation of the carbonates, further reducing the permeability of the formation at the fracture faces.

The present invention provides a method for generating fracture within a subsurface coal seam which have an improved conductivity, an increased production rate and an increased total recovery of gas therefrom in comparison with methods previously attempted fracturing coal seams.

SUMMARY OF THE INVENTION

The invention is directed to a method for generating fractures within a subsurface coal seam which have an improved conductivity and more uniform width. Broadly, the method comprises injecting stagewise into the formation adjacent the well a proppant-containing fracing fluid alternated with an acidizing solution.

The fracing fluid has suspended therein fine proppants with a particle size distribution substantially between 60 and 140 mesh (all mesh sizes herein refer to the U.S. standard sieve series), preferably averaging 100 mesh. The proppants are present in the initial fracing fluid injection stages in an amount ranging from about 0 to about 4 pounds per gallon of fracing fluid. The proppant loading in the fracing fluid is increased in subsequent injection stages until the fracing fluid contains from about 8 to about 12 pounds of proppant per gallon of fluid. Thereafter, the fracing liquid injections are continued at the higher proppant loading. Each fracing liquid stage is immediately followed by injection of an acidizing solution into the formation adjacent the well.

The alternating injections of fracing fluid and acid are performed at a rate of from about 15 to about 35 barrels per minute, preferably 20 to 30 barrels per minute, and continuing until at least 3,000 pounds of the fine proppants have been deposited in the formation fracture per vertical foot of the coal seam. Preferably, the terminal injection stage of proppant-containing fracing fluid is followed by a proppant-free fracing fluid or acidizing solution flush of the tubing string.

The fracing fluid is preferably water from the coal seam or adjacent formation to which a gelling agent is added at the rate of about 30 pounds per 1,000 gallons. The acid may be any acid typically used for treating subsurface formations, such as acetic, formic, hydrofluoric, or sulfamic, but is preferably hydrochloric acid. Additionally, the fracing fluid or acidizing solution may contain surfactants, suspending agents, sequestering agents, anti-sludge agents, or corrosion inhibitors.

DETAILED DESCRIPTION OF THE PREFERRED EMBODIMENTS

The method of the present invention can be carried out by any conventional apparatus used for previously known methods of hydraulic fracturing. Conventional proppant-water mixing equipment and pumping equipment may be utilized in performing the method. The fracturing fluid and acid can be injected through the well tubing, casing or other available or suitable pipe or conduit. The fluid can be injected through perforations in the casing extending through the cement and directly into the formation, the injection being confined to the selected coal seam through conventional isolation techniques. Preferably, however, the well is completed by conventional open-hole techniques to avoid the problem of sand-out which can occur when the fracing fluid must flow through casing performations, especially at the higher proppant loading in the method of the invention. Normally, the shales of the strata overlying and underlying the coal seam are of sufficient hardness to confine the fracture to the coal seam.

Although it is possible to use water or other fluid from any suitable source, the fracturing fluid preferably used in carrying out the method of the present invention is water produced from the coal seam or adjacent formation to which is added conventional gels, such as, for example, guar gum, modifed guar gums, polysaccharide derivatives, cellulose derivatives, or synthetic polymers, to obtain a sufficient viscosity to suspend the proppants. Preferably, a substitive guar gum such as HPG (hydroxy propyl guar gum) sold under the designation of WG11 by Halliburton or WG-A2 by Smith Energy is added at the rate of about 30 pounds per 1,000 gallons of formation water.

Proppant is added to the fracing fluid in the initial stage at a rate ranging from about 0 (proppant-free) to about 4 pounds per gallon of fracing fluid.

The succeeding stages have a proppant loading of from about 2 to about 4 pounds per gallon of fluid initially which is incrementally increased in succeeding stages to a proppant loading of from about 8 to about 12 pounds per gallon of fluid. Thereafter, the proppant loading is at the 8–12 pounds per gallon rate, preferably 10 pounds per gallon. Each incremental increase is preferably from about 0 to about 3 pounds per gallon.

The proppant has a particle size distribution substantially between 60 and 140 mesh, preferably averaging 100 mesh. Preferably, the proppant is spherically shaped rather than angularly shaped. Oklahoma 100 mesh sand has been found suitable for most applications.

The proppant-containing fracing fluid is injected into the formation in multiple stages. The rate of injection may range from about 15 to about 35 barrels per minute, but best results are obtained at an injection rate of 20–30 barrels per minute. The volume of each fracing fluid injection stage is determined in advance thereof and depends on the size of the fracture desired and the pressure and flow resistance. Normally, 2,000–8,000 gallons per stage produce suitable results. Preferably, the volume of the initial fracing fluid injection stage is from about 2,000 to about 4,000 gallons, and the volume is increased in each following injection stage, as the sand loading is increased, to from about 6,000 to about 8,000 gallons, preferably 7,000 gallons, for subsequent and terminal fracing fluid injection stages. The stages are continued until at least about 3,000 pounds of proppant have been deposited in the formation fracture per vertical foot of the coal seam. With the fracturing method of the invention it is possible to place very large quantities of proppant into the formation. With the method of the invention 500,000 pounds of proppant have been readily deposited to the fractures within the formation and greater quantities may be deposited, when desired. Thus for a coal seam of average width (typically about 30 feet) the fracturing method of the invention may be continued until at least about 15,000 pounds of proppant per vertical foot of the coal seam have been deposited in the formation fractures.

The fine, spherical proppant is believed to serve several functions in the invention. As it is injected into the fracture, the spherical shape of the proppant substantially reduces abrasion to the face of the fracture, thereby largely eliminating the problems associated with particles of coal becoming mixed with the proppant. Additionally, spherical proppants having a small particle size exhibit less tendency to become embedded in the face of the fracture and inhibit creep of the coal into the propped fracture. When the pressure on the fracing fluid is reduced and the formation face is allowed to compress the proppants, the proppant particles in the fractures provide a formation consolidating effect, similar to that of gravel packing in a well completed in a poorly consolidated formation by filtering out the coal particles which would otherwise slough off of the fracture faces and plug the interstitial spaces between the proppant particles. The permeability of fine proppants is much greater than that of the coal seam. Thus, if the fracture is wide enough, the conductivity of the propped fracture is sufficient to improve production and overall recovery of gas from the well.

Immediately following each proppant-containing fracing fluid injection stage, acidizing solution is injected into the formation. The acidizing solution may contain any conventional acid normally used for treating subsurface formations at typical concentrations. These acids include acetic acid, formic acid, hydrofluoric acid or sulfamic acid. Suitable results are obtained with an aqueous acidizing solution containing 15 percent by weight hydrochloric acid. The acid solution may also contain conventional additives such as surfactants, suspending agents, sequestering agents, anti-sludge agents, or corrosion inhibitors. If desired, the acidizing solution may contain about 1 pound of proppant per gallon of solution.

The acid is injected into the formation at about the same rate as the fracing fluid injection stages. The volume of acidizing solution injected depends on the size of the fracture and pressure and flow resistance, but injection of from about 250 to about 1500 gallons, usually about 750 gallons, of an acidizing solution of 15 percent by weight hydrochloric acid between each fracing fluid stage is suitable for most fractures. If desired, the formation may be treated with 500–3000 gallons of the acidizing solution prior to the injection of the initial fracing fluid stage.

The acid is believed to serve several functions in the invention. Because the acidizing solution is less dense than the fracing fluid, it tends to flow above the fracing fluid and sand deposited in the lower portion of a vertical fracture, widening and vertically extending the upper portion of the fracture. The acidizing solution also has a tendency to divert from existing fractures and to initiate new fractures which are filled with proppant during the subsequent fracing fluid injection stages. Finally, the acid cleans the well bore and fracture faces by solubilizing any precipitates or contaminants due to drilling or completion fluids or cement which may be present at or adjacent the well bore or fracture faces.

The invention is illustrated by way of the following examples of treatment of coal seams in La Plata County, Colo.:

EXAMPLE 1

| | |
|---|---|
| Formation Thickness: | 82 feet |
| Depth: | 2535–2617 feet |
| Fracing Fluid: | Formation water, plus 30 pounds per 1,000 gallons of a hydroxyl propyl guar gum gelling agent. |

-continued

| | |
|---|---|
| Propping Agent: | 100 mesh Oklahoma sand, 502,603 pounds |
| Acid: | 15% HCl |
| Casing: | Open Hole |
| Average Pressure | 2010 psi |
| Average Injection Rate | 27 BPM |
| Number of Fracing Fluid Stages | 13 |
| Volume of Fracing Fluid (Less Sand Volume) | 62,834 Gallons |
| Volume of Acid | 8,000 Gallons |
| Total Fluid Volume | 70,834 Gallons |

| Event No. | Fluid | Sand (ppg) | Fluid Vol. (Gal.) | Stage Vol. (Gal.) | Rate (BPM) | Pressure (psi) |
|---|---|---|---|---|---|---|
| 1 | Acid | 0 | 2000 | 2000 | 26.5 | 3000 |
| 2 | Pad | 0 | 3000 | 3000 | 26.5 | 1600 |
| 3 | Frac | 2 | 2749 | 3000 | 27.0 | 1625 |
| 4 | Frac | 3 | 2639 | 3000 | 26.5 | 1650 |
| 5 | Acid | 1 | 500 | 523 | 26.5 | 1800 |
| 6 | Frac | 5 | 4071 | 5000 | 27.0 | 1800 |
| 7 | Acid | 1 | 500 | 523 | 26.9 | 1800 |
| 8 | Frac | 7 | 3790 | 5000 | 26.9 | 1800 |
| 9 | Acid | 1 | 500 | 523 | 27.0 | 1830 |
| 10 | Frac | 8 | 5129 | 7000 | 27.0 | 1900 |
| 11 | Acid | 1 | 500 | 523 | 27.0 | 1920 |
| 12 | Frac | 10 | 4807 | 7000 | 27.0 | 1950 |
| 13 | Acid | 1 | 500 | 523 | 27.0 | 1980 |
| 14 | Frac | 10 | 4807 | 7000 | 27.0 | 1980 |
| 15 | Acid | 1 | 500 | 523 | 27.0 | 2050 |
| 16 | Frac | 10 | 4807 | 7000 | 26.5 | 2090 |
| 17 | Acid | 1 | 500 | 523 | 26.7 | 2100 |
| 18 | Frac | 10 | 4807 | 7000 | 26.3 | 2100 |
| 19 | Acid | 1 | 500 | 523 | 26.8 | 2150 |
| 20 | Frac | 10 | 4807 | 7000 | 26.8 | 2150 |
| 21 | Acid | 1 | 500 | 523 | 27.0 | 2125 |
| 22 | Frac | 10 | 4807 | 7000 | 26.9 | 2200 |
| 23 | Acid | 0.93 | 750 | 782 | 27.0 | 2150 |
| 24 | Frac | 10 | 4807 | 7000 | 26.4 | 2175 |
| 25 | Acid | 0.93 | 750 | 782 | 26.8 | 2190 |
| 26 | Frac | 10 | 4807 | 7000 | 26.9 | 2140 |
| 27 | Flush | 0 | 3000 | 3000 | 26.7 | 2040 |

EXAMPLE 2

| | |
|---|---|
| Formation Thickness: | 72 feet |
| Depth: | 3107–3179 feet |
| Fracing Fluid: | Formation Water, plus 30 pounds per 1000 gallons of a hydroxyl propyl gelling agent. |
| Propping Agent: | 100 mesh Oklahoma sand, 236,380 pounds |
| Acid: | 15% HCL |
| Casing: | Open Hole |
| Average Pressure: | 3700 psi |
| Average Injection Rule: | 24.5 BPM |
| Number of Fracing Fluid Stages: | 12 |
| Volume of Fracing Fluid: (Less sand volume) | 68,004 Gallons |
| Volume of Acid: | 10,500 Gallons |
| Total Fluid Volume: | 78,504 Gallons |

| Event No. | Fluid | Sand (ppg) | Fluid Vol. (gal.) | Stage Vol. (gal.) | Rake (BPM) | Pressure (psi) |
|---|---|---|---|---|---|---|
| 1 | Acid | 0 | 2000 | 2000 | 26 | 2650 |
| 2 | Pad | 0 | 3000 | 3000 | 25 | 2800 |
| 3 | Frac | 2 | 2747 | 3000 | 25 | 3000 |
| 4 | Frac | 3 | 2638 | 3000 | 25 | 3200 |
| 5 | Acid | 0 | 750 | 750 | 25 | 3500 |
| 6 | Frac | 5 | 1710 | 2100 | 25 | 3650 |
| 7 | Frac | 0 | 4100 | 4100 | 25 | 3700 |
| 8 | Frac | 2 | 5000 | 5460 | 25 | 3800 |
| 9 | Frac | 0 | 5850 | 5850 | 25 | 3850 |
| 10 | Frac | 2 | 5723 | 5723 | 24 | 3850 |
| 11 | Acid | 0 | 750 | 750 | 24 | 3900 |
| 12 | Pad | 0 | 2250 | 2250 | NR | NR |

-continued

| | | | | | | |
|---|---|---|---|---|---|---|
| 13 | Acid | 0 | 750 | 750 | 24 | 3900 |
| 14 | Pad | 0 | 1850 | 1850 | 24 | 3700 |
| 15 | Acid | 0 | 750 | 750 | 24 | 3700 |
| 16 | Pad | 0 | 2000 | 2000 | 24 | 3400 |
| 17 | Acid | 0 | 1000 | 1000 | 24 | 3450 |
| 18 | Pad | 0 | 3600 | 3600 | 24 | 3400 |
| 19 | Frac | 2 | 2747 | 3000 | 24 | 3400 |
| 20 | Acid | 0 | 1000 | 1000 | 24 | 3500 |
| 21 | Frac | 3 | 2638 | 3000 | 24 | 3600 |
| 22 | Acid | 0 | 1000 | 1000 | 24 | 3650 |
| 23 | Frac | 5 | 4071 | 5000 | 24 | 3500 |
| 24 | Acid | 0 | 500 | 500 | 24 | 3500 |
| 25 | Frac | 7 | 3790 | 5000 | 24 | 3400 |
| 26 | Acid | 0 | 500 | 500 | 23 | 3400 |
| 27 | Frac | 8 | 5129 | 7000 | 23 | 3400 |
| 28 | Acid | 0 | 500 | 500 | 23 | 3400 |
| 29 | Frac | 10 | 4807 | 7000 | 24.5 | 3300 |
| 30 | Acid | 0 | 500 | 500 | 24.5 | 3400 |
| 31 | Frac | 10 | 4354 | 6340 | 24.5 | 3400 |
| 32 | Flush | 0 | 2000 | 2000 | 24 | 3400 |

NR = Data not recorded.

EXAMPLE 3

| | |
|---|---|
| Formation Thickness: | 15 Feet |
| Depth: | 2282–1197 Feet |
| Fracing Fluid: | Formation water, plus 30 pounds per 1000 gallons of a hydroxyl propyl guar gum gelling agent. |
| Propping Agent: | 100 mesh Oklahoma sand, 467,158 pounds |
| Acid: | 15% HCL |
| Casing: | Open Hole |
| Average Pressure: | 3300 psi |
| Average Injection Rule: | 23 BPM |
| Number of Fracing Fluid Stages: | 13 |
| Volume of Fracing Fluid: (Less sand volume) | 76,450 Gallons |
| Volume of Acid: | 10,250 Gallons |
| Total Fluid Volume: | 86,700 Gallons |

| Event No. | Fluid | Sand (ppg) | Fluid Vol. (Gal.) | Stage Vol. (Gal.) | Rate (BPM) | Pressure (psi) |
|---|---|---|---|---|---|---|
| 1 | Acid | 0 | 2000 | 2000 | 25.8 | 3600 |
| 2 | Pad | 0 | 3000 | 3000 | 25.8 | 1900 |
| 3 | Frac | 2 | 2749 | 3000 | 25.8 | 2600 |
| 4 | Frac | 3 | 2639 | 3000 | 25.8 | 2100 |
| 5 | Acid | 0 | 750 | 750 | 25.8 | 2400 |
| 6 | Frac | 5 | 4071 | 5000 | 25.8 | 3600 |
| 7 | Acid | 0 | 750 | 750 | 25 | 3600 |
| 8 | Frac | 7 | 3790 | 5000 | 25 | 3600 |
| 9 | Acid | 0 | 1000 | 1000 | 24.8 | 3800 |
| 10 | Frac | 8 | 5129 | 7000 | 25 | 4200 |
| 11 | Acid | 0 | 750 | 750 | 24 | 4500 |
| 12 | Pad | 0 | 1500 | 1500 | 20 | 4600 |
| 13 | Acid | 0 | 1000 | 1000 | 21 | 3800 |
| 14 | Pad | 0 | 1500 | 1500 | 21 | 3600 |
| 15 | Frac | 2 | 2749 | 3000 | 21 | 3400 |
| 16 | Acid | 0 | 750 | 750 | 23 | 3600 |
| 17 | Frac | 3 | 2639 | 3000 | 23 | 3600 |
| 18 | Acid | 0 | 750 | 750 | 23 | 3550 |
| 19 | Frac | 4 | 3383 | 4000 | 22.5 | 3650 |
| 20 | Acid | 0 | 750 | 750 | 23 | 3700 |
| 21 | Frac | 5 | 4071 | 5000 | 23 | 3100 |
| 22 | Acid | 0 | 750 | 750 | 23 | 3000 |
| 23 | Frac | 7 | 5306 | 7000 | 23 | 2900 |
| 24 | Acid | 0 | 350 | 350 | 23 | 2900 |
| 25 | Frac | 8 | 5129 | 7000 | 23 | 2975 |
| 26 | Acid | 0 | 350 | 350 | 23 | 3000 |
| 27 | Frac | 10 | 4807 | 7000 | 23 | 3100 |
| 28 | Acid | 0 | 300 | 300 | 23 | 3200 |
| 29 | Frac | 10 | 19228 | 28000 | 23.5 | 3000 |
| 30 | Flush | 0 | 3000 | 3000 | 23.5 | 2950 |

In Example 1, fracturing of a coal seam proceeds in a manner which is typical according to the invention. A large volume of acid is used in step 1 to initially treat the coal seam and is followed by a pad of proppant-free fracing fluid. In the initial proppant injection stage, fracing fluid to which sand has been added at the rate of 2 pounds per gallon of fracing fluid was injected into the formation, followed by a 3 pound per gallon stage which in turn was followed by an acid stage. Thereafter, the sand loading and/or volume of the fracing fluid injection stage was increased in each stage until a stand loading of 10 pounds per gallon and a volume of 7000 gallons was reached in step 12. The subsequent fracing fluid injection stages were continued at this sand loading and volume until a sufficient amount of sand was deposited on the formation. Following the terminal fracing fluid injection stage, the well was flushed with a volume of sand-free fracing fluid.

The well had negligible production before fracing and produced gas at 320 MSCFD thereafter. With continued production, the gas rate increased as water was removed. The majority of coal seams fractured thus far have been adequately fractured according to the invention with minor variations from Example 1 with similar results.

In Examples 2 and 3, some difficulty was experienced in that the fractures began to sand out as indicated by the pressure increases at steps 11 and 10, respectively. The sand out was eliminated by alternating acid and pad injections until a pressure reduction was observed, indicating that the fractures were propagating. When propagation of the fractures was observed, the alternating stagewise injection of acid and fracturing fluid was reinitiated at the lower proppant loading and stage volumes. In subsequent stages the volume and proppant loading was incrementally increased according to the invention. Prior to treatment the well of Example 2 had negligible production. After fracturing this well began production at 360 MSCFD. The well of Example 3 had negligible production prior to fracturing. Since treatment the well of Example 3 has not yet been placed on line, so after fracturing production figures are not yet available.

It is important in sand out situations that the pressure not be allowed to increase excessively (above about 4500 psi for the particular formations treated in the examples) because of the danger of fracturing the underlying or overlying non-producing formations. It is also important to immediately take preventative measures whenever sand out is threatened because of the danger of sanding out the well and having to abort the fracturing operation.

The foregoing disclosure and description of the invention are illustrative and explanatory thereof, and various changes in the size, shape and materials, as well as in the details of the illustrated process may be made without departing from the spirit of the invention.

I claim:

1. A method for fracturing a gas-containing subsurface coal formation penetrated by a well, comprising the steps of:

injecting a fracing fluid into the formation adjacent the well in a multiplicity of stages, said fracing fluid having suspended therein fine proppants with a particle size distribution substantially between 60 and 140 mesh, said fine proppants added to said fluid at a rate ranging from about 2 to about 12 pounds per gallon of said fluid; and injecting an acidizing solution into the formation adjacent the well immediately following each of said fracing fluid injection stages, said injections of fracing fluid and acidizing solution being at a rate of from about 15 to about 35 barrels per minute and continuing until at least 3,000 pounds of said fine proppants have been deposited in the formation fracture per linear vertical foot of the formation.

2. The method of claim 1, wherein said fine proppants comprise spherically shaped particles.

3. The method of claim 2, wherein said fracing fluid is formation fluid containing about 30 pounds gelling agent per 1,000 gallons of fracing fluid.

4. The method of claim 1, wherein said acidizing solution is about 15 percent by weight aqueous hydrochloric acid.

5. The method of claim 1, wherein said injection rate is from about 20 to about 30 barrels per minute.

6. The method of claim 1, further comprising the steps of:

injecting a terminal stage of said fracing fluid having suspended therein said proppants added to said fluid at a rate of from about 8 to about 12 pounds per gallon of said fluid; and immediately following said injection of said terminal stage, injecting a flushing stage of proppant-free fluid.

7. A method for fracturing a gas-containing subsurface coal formation penetrated by a well, comprising the steps of:

injecting an initial stage of fracing fluid into the formation adjacent the well, said fracing fluid having fine proppants suspended therein at a loading of from about 0 to about 4 pounds per gallon of said fluid, said proppants having a particle size distribution substantially between 60 and 140 mesh;

injecting a plurality of successive stages of fracing fluid into the formation, said fracing fluid having said proppants suspended therein initially at a loading of from about 2 to about 4 pounds per gallon of fluid, said proppant loading being incrementally increased in succeeding fracing fluid injection stages to a proppant loading of from about 8 to about 12 pounds per gallon of fluid, said injection of said fracing fluid injection stages thereafter continuing at said 8–12 pounds per gallon proppant loading until at least 3000 pounds of said proppants have been deposited in the formation per linear vertical foot of formation; and injecting stages of acidizing solution into the formation adjacent the well between said fracing fluid injection stages, each of said acidizing solution and said fracing fluid stages being injected at a rate of from about 15 to about 35 barrels per minute.

8. The method of claim 7, wherein said proppants are spherically shaped particles.

9. The method of claim 8, wherein said particles are sand having an average particle size of about 100 mesh.

10. The method of claim 7, wherein said fracing fluid injection stages have a volume of from about 1000 to about 10,000 gallons per stage.

11. The method of claim 10, wherein said acidizing solution injection stages have a volume of from about 250 to about 1500 gallons per stage.

12. The method of claim 11 wherein said incremental increase in proppant loading is from about 0 to about 3 pounds of proppant per gallon of fluid.

13. The method of claim 12, wherein said volume of said fracing fluid injection stages is initially from about 1000 to about 4000 gallons per stage, said volume being incrementally increased in suceeding fracing fluid injection stages to from about 5000 to about 10,000 gallons per stage, said fracing fluid injection stages continuing thereafter at said 5000–10,000 gallons per stage volume.

14. The method of claim 13, wherein said incremental increase in stage volume is from about 0 to about 3000 gallons per stage.

15. The method of claim 14, wherein said fracing fluid is formation water containing about 30 pounds gelling agent per 1000 gallons of said water.

16. The method of claim 15, wherein said acidizing solution is about 15 percent by weight aqueous hydrochloric acid.

17. The method of claim 16, wherein said injection rate is from about 20 to about 30 barrels per minute.

18. A gas-yielding subterranean earth formation, comprising:

a fractured gas-containing subsurface coal formation, said fracture resulting from the steps of:

(a) injecting a fracing fluid into the formation adjacent a well penetrating such formation in a multiplicity of stages, said fracing fluid having suspended therein fine proppants with a particle size distribution substantially between 60 and 140 mesh, said fine proppants added to said fluid at a rate ranging from about 2 to about 12 pounds per gallon of said fluid; and (b) injecting an acidizing solution into the formation adjacent the well immediately following each of said fracing fluid injection stages, said injections of fracing fluid and acidizing solution being at a rate of from about 15 to about 35 barrels per minute and continuing until at least 3,000 pounds of said fine proppants have been deposited in the formation fracture per linear vertical foot of the formation.

19. The formation of claim 18, wherein said fine proppants comprise spherically shaped particles.

20. The formation of claim 19, wherein said fracing fluid is formation fluid containing about 30 pounds gelling agent per 1,000 gallons of fracing fluid.

21. The formation of claim 18, wherein said acidizing solution is about 15 percent by weight aqueous hydrochloric acid.

22. The formation of claim 18, wherein said injection rate is from about 20 to about 30 barrels per minute.

23. The formation of claim 18, wherein said fracturing steps further comprise:

injecting a terminal stage of said fracing fluid having suspended therein said proppants added to said fluid at a rate of from about 8 to about 12 pounds per gallon of said fluid; and immediately following said injection of said terminal stage, injecting a flushing stage of proppant-free fluid.

24. A gas-yielding subterranean earth formation, comprising:

a fractured gas-containing subsurface coal formation, said fracture resulting from the steps of:

injecting an initial stage of fracing fluid into the formation adjacent a well penetrating such formation, said fracing fluid having fine proppants suspended therein at a loading of from about 0 to about 4 pounds per gallon of said fluid, said proppants having a particle size distribution substantially between 60 and 140 mesh;

injecting a plurality of successive stages of fracing fluid into the formation, said fracing fluid having said proppants suspened therein initially at a loading of from about 2 to about 4 pounds per gallon of fluid, said proppant loading being incrementally increased in succeeding fracing fluid injection stages to a proppant loading of from about 8 to about 12 pounds per gallon of fluid, said injection of said fracing fluid injection stages thereafter continuing at said 8–12 pounds per gallon proppant loading until at least 3000 pounds of said proppants have been deposited in the formation per linear vertical foot of formation; and injecting stages of acidizing solution into the formation adjacent the well between said fracing fluid injection stages, each of said acidizing solution and said fracing fluid stages being injected at a rate of from about 15 to about 35 barrels per minute.

25. The formation of claim 24, wherein said proppants are spherically shaped particles.

26. The formation of claim 25, wherein said particles are sand having an average particle size of about 100 mesh.

27. The formation of claim 24, wherein said fracing fluid injection stages have a volume of from about 1000 to about 10,000 gallons per stage.

28. The formation of claim 27, wherein said acidizing solution injection stages have a volume of from about 250 to about 1500 gallons per stage.

29. The formation of claim 28 wherein said incremental increase in proppant loading is from about 0 to about 3 pounds of proppant per gallon of fluid.

30. The formation of claim 29, wherein said volume of said fracing fluid injection stages is initially from about 1000 to about 4000 gallons per stage, said volume being incrementally increased in succeeding fracing fluid injection stages to from about 5000 to about 10,000 gallons per stage, said fracing fluid injection stages continuing thereafter at said 5000–10,000 gallons per stage volume.

31. The formation of claim 30, wherein said incremental increase in stage volume is from about 0 to about 3000 gallons per stage.

32. The formation of claim 31, wherein said fracing fluid is formation water containing about 30 pounds gelling agent per 1000 gallons of said water.

33. The formation of claim 32, wherein said acidizing solution is about 15 percent by weight aqueous hydrochloric acid.

34. The formation of claim 33, wherein said injection rate is from about 20 to about 30 barrels per minute.

* * * * *